United States Patent [19]

Schloemann

[11] Patent Number: 4,842,721

[45] Date of Patent: Jun. 27, 1989

[54] TRANSVERSELY INCLINED RAMP SEPARATOR

[75] Inventor: Ernst F. R. A. Schloemann, Weston, Mass.

[73] Assignee: Raytheon Company, Lexington, Mass.

[21] Appl. No.: 133,167

[22] Filed: Dec. 11, 1987

Related U.S. Application Data

[63] Continuation of Ser. No. 946,669, Dec. 31, 1986, abandoned, Continuation of Ser. No. 747,380, Jun. 21, 1985, abandoned, Continuation of Ser. No. 435,160, Oct. 19, 1982, abandoned.

[51] Int. Cl.[4] ..... B03C 1/02

[52] U.S. Cl. ..... 209/212; 209/223.1; 209/225; 209/229; 209/231

[58] Field of Search ..... 209/212, 213, 214, 223.1, 209/225, 228, 229, 231, 232

[56] References Cited

U.S. PATENT DOCUMENTS

| | | | |
|---|---|---|---|
| 854,768 | 3/1907 | Snyder | 209/223.1 |
| 1,104,300 | 7/1914 | Huelsdonk | 209/441 |
| 1,463,713 | 7/1923 | Mordey | 209/223.1 |
| 1,729,589 | 9/1929 | Mordey | 209/223.1 |
| 3,341,021 | 9/1967 | Casson | 209/229 |
| 4,003,830 | 1/1977 | Schloemann | 209/3 |
| 4,008,301 | 1/1977 | Schloemann | 209/3 |
| 4,083,774 | 4/1978 | Hunter | 209/223.1 |
| 4,134,829 | 1/1979 | Bender et al. | 209/223.1 |
| 4,229,288 | 10/1980 | Akama | 209/212 |
| 4,235,710 | 11/1980 | Sun | 209/232 X |
| 4,313,543 | 2/1982 | Paterson | 209/220 |

*Primary Examiner*—Robert B. Reeves
*Assistant Examiner*—Edward M. Wacyra
*Attorney, Agent, or Firm*—John T. Meaney; William R. Clark; Richard M. Sharkansky

[57] ABSTRACT

A materials separator apparatus comprising a base supporting a ramp type of materials receiving surface sloped longitudinally and transversely with respect to the base for directing commingled dielectric items and electrically conductive items of nonferromagnetic materials deposited on its upper end portion along a fall path extended longitudinally and transversely downward of the surface, and a planar series of substantially parallel permanent bar magnets supported in contiguous rows in a plane substantially parallel to the material receiving surface and sufficiently close thereto for establishing along the surface a spatially alternating array of oppositely directed static magnetic fields which extend in substantially parallel relationship transversely of the surface at an oblique angle with the fall path of the commingled items. As a result, there is exerted on the electrically conductive items an electromagnetic force having a laterally directed component of sufficient magnitude for deflecting the electrically conductive items laterally out of the fall path and transversely upward of the materials receiving surface while the electrically conductive items are travelling longitudinally down the materials receiving surface.

7 Claims, 6 Drawing Sheets

TRANSVERSELY INCLINED RAMP SEPARATOR

This application is a continuation of application Ser. No. 946,669, filed Dec. 31, 1986, abandoned, which is a continuation of application Ser. No. 747,380, filed June 21, 1985, abandoned, which is a continuation of application Ser. No. 435,160, filed Oct. 19, 1982 abandoned.

BACKGROUND OF THE INVENTION

1. Field of the Invention

This invention relates generally to materials separator apparatus and is concerned more particularly with a materials separator having eddy-current inducing means for separating electrically conductive items from commingled dielectric items of nonferromagnetic materials.

2. Discussion of the Prior Art

In the recycle processing of waste materials, solid municipal waste initially may be shredded into items of more manageable size which are directed into a stream, as by feeding them onto a moving endless conveyor belt, for example. The stream of shredded waste material may be conducted to a conventional air classifier for removing light fraction items, such as paper products, for example. A resulting stream of heavy fraction items then may be passed through a conventional magnetic separator where ferromagnetic items of high permeability material, such as iron products, for example, are removed from the stream. The non-ferromagnetic materials then remaining in the stream comprise dielectric items, such as plastic, rubber, wood and glass, for example, and electrically conductive items such as aluminum, silver, copper and zinc, for example. These electrically conductive items constitute a significant percentage of the total resale value of recycled municipal waste material. Consequently, there has been developed in the prior art a number of materials separators for segregating electrically conductive items from commingled dielectric items of nonferromagnetic materials.

In U.S. Pat. No. 4,003,830 granted to E. Schloemann on Jan. 19, 1977 and assigned to the present assignee, there is shown a ramp type of nonferromagnetic materials separator having a longitudinally sloped surface which extends transversely at substantially right angles to an imaginary plane passed vertically through its longitudinal centerline. This ramp type of separator is provided with steady-state magnetic means for establishing along said sloped surface a spatially alternating series of oppositely polarized and substantially parallel magnetic stripes which extend transversely at an oblique angle with respect to the longitudinal centerline of said sloped surface. A stream of commingled nonferromagnetic items is directed onto the upper end portion of said sloped surface and adjacent a first longitudinal side thereof to slide down the sloped surface under the influence of gravity.

Since the dielectric items of nonferromagnetic material in the stream are unaffected by the array of oppositely directed magnetic fields established by said magnetic stripes, they continue to slide down the longitudinally sloped surface of the separator and may be collected at the bottom adjacent said first longitudinal side thereof. On the other hand, the electrically conductive items of nonferromagnetic material in passing sequentially through the oppositely directed magnetic fields of the array have induced in them eddy-currents which coact with the magnetic fields. As a result, these electrically conductive items have exerted on them a resultant force which is directed upwardly of the longitudinally sloped surface and substantially perpendicular to the magnetic stripes. Consequently the resultant forces have respective components which deflect the electrically conductive items laterally while they are sliding longitudinally down the sloped surface. Thus, the electrically conductive items may be collected at the bottom of the sloped surface and adjacent the second or opposing longitudinal side thereof.

Although the described separator operates satisfactorily for segregating electrically conductive items from commingled dielectric items of nonferromagnetic materials, its efficiency in the segregation process is not one hundred percent. Consequently, there may be disposed between the respective containers for collecting the dielectric items and the electrically conductive items at the bottom of the ramp one or more containers for collecting the "middlings". The "middlings" comprise a mixture of the dielectric and the electrically conductive items resulting from incomplete separations of these items. In some instances, the percentage of dielectric items in the "middlings" may be considered to be objectionable because, among other reasons, excessive lateral spreading of the dielectric items takes place as they slide longitudinally down the ramp and high feed rates cause a relatively larger number of collisions to occur on the ramp surface between the dielectric items and the deflected electrically conductive items.

SUMMARY OF THE INVENTION

Accordingly, these and other disadvantages of the prior art are overcome by this invention providing a nonferromagnetic materials separator of the ramp type with a materials receiving surface which is sloped not only longitudinally but also transversely. Thus, the longitudinally sloped receiving surface of this materials separator extends transversely at an oblique angle with respect to an imaginary plane passed vertically through the longitudinal centerline of the receiving surface. Consequently, one longitudinal half of the receiving surface forms an acute angle measured clockwise from the upper portion of said vertical plane; and the other longitudinal half of the receiving surface forms an acute angle measured clockwise from the lower portion of said vertical plane.

This separator also includes steady-state magnetic means disposed in parallel adjacent relationship with the materials receiving surface and comprising an alternating series of substantially parallel and oppositely polarized magnets having respective poles adjacent said surface. These magnets extend transversely of said surface at an oblique angle with the longitudinal centerline thereof. As a result, there is established along the materials receiving surface a spatially alternating array of oppositely directed and substantially parallel magnetic fields which extend transversely at an oblique angle with the longitudinal centerline of the surface.

In operation, commingled items of nonferromagnetic material are deposited on the upper end portion of the materials receiving surface. As a result, the deposited items are acted upon by orthogonally directed components of gravity. A longitudinallv directed component of gravity urges the items to slide longitudinllly down the materials receiving surface; while a laterally directed component of gravity urges the items to slide transversely toward the lower longitudinal side of the materials receiving surface. Consequently, the dielectric items of nonferromagnetic material, which are unaffected by the magnetic fields, may be collected at the lower end of the materials receiving surface and adjacent the lower longitudinal side thereof.

The electrically conductive items of nonferromagnetic material, while passing through the magnetic fields, have induced therein respective eddy-currents which coact with the magnetic fields to exert a resultant force on these items. The resultant force has a laterally directed component which deflects the electrically conductive items laterally toward the higher longitudinal side of the materials receiving surface and against the laterally directed component of gravity. Consequently, the electrically conductive items may be collected at the lower end of the materials receiving surface and adjacent the higher longitudinal side thereof.

Therefore, with a laterally directed component of gravity aiding in the separation of electrically conductive items and dielectric items the input commingled items of nonferromagnetic material may be deposited anywhere transversely at the upper end portion of the materials receiving surface. Accordingly, this separator may be provided with input feed means having its output disposed for depositing commingled items of nonferromagnetic material all across the upper or input end portion of the materials receiving surface. Also, this separator may comprise a corrugated array of longitudinally juxtaposed ramps. Thus, the input handling capacity of this transversely inclined ramp-type separator may be increased to as much as ten times the input handling capacity of a conventional ramp-type separator.

BRIEF DESCRIPTION OF THE DRAWINGS

For a better understanding of this invention, reference is made in the following detailed description to the accompanying drawings wherein.

DESCRIPTION OF THE PREFERRED EMBODIMENTS

Figure 1:
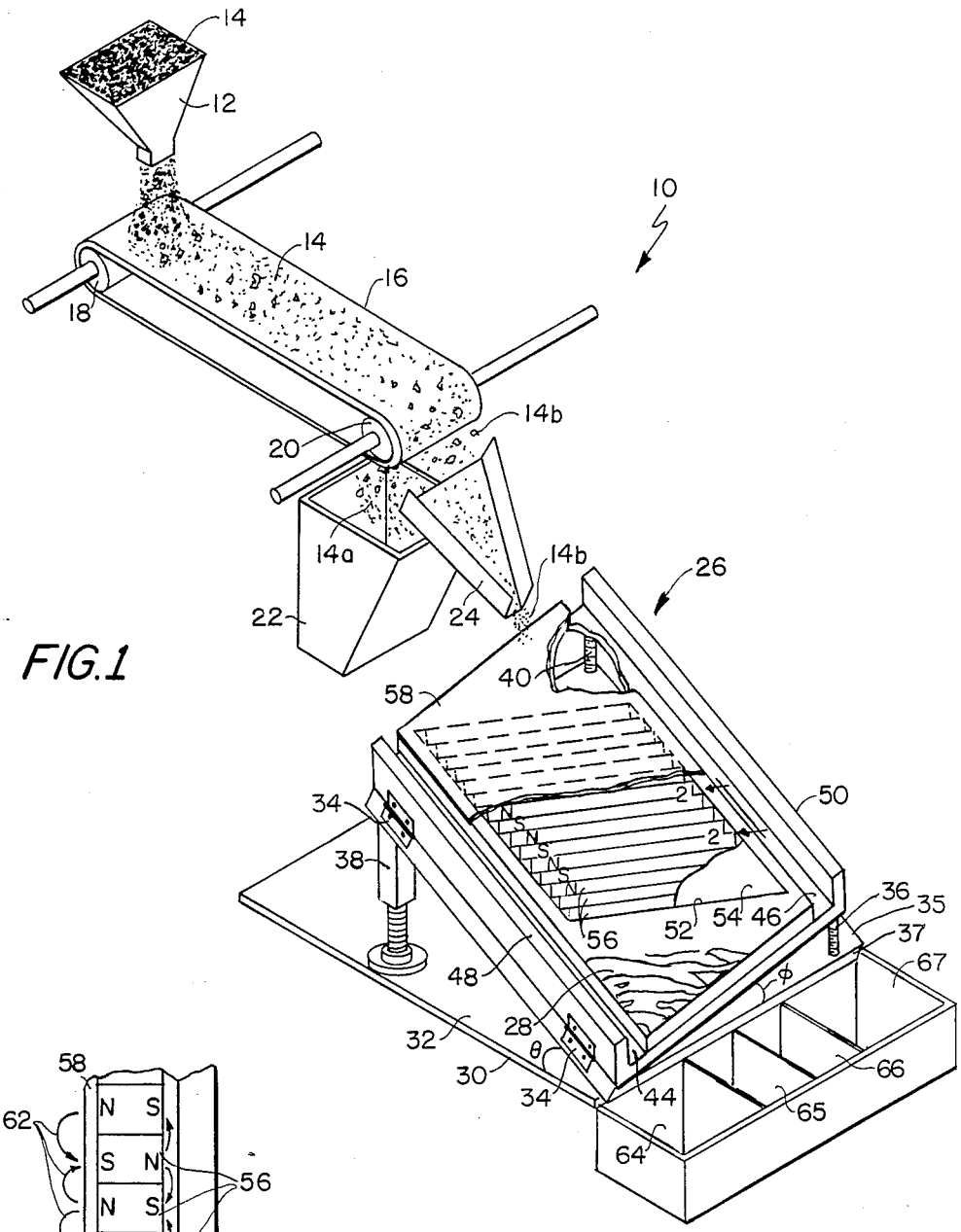
FIG. 1 is a schematic isometric view of materials separator apparatus embodying the invention.

Referring to the drawings wherein like characters of reference designate like parts, FIG. 1 shows a materials separator apparatus 10 having material feed means comprising a funnel-shaped hopper 12 disposed for receiving commingled items 14 of heavy fraction waste material. The items 14 may be obtained from previous processing steps of shredding solid municipal waste into items of manageable size and removing the light fraction items, such as paper products, for example, by conventional air classifier means (not shown). The resulting commingled items 14 of heavy fraction materials deposited in hopper 12 are directed into a stream emerging from the output end portion of hopper 12 and falling onto a moving endless belt 16 of a material conveyor means.

Belt 16 is made of pliable non-magnetic material, such as rubber, for example, which travels around a drive roller 18 to pass under the output end portion of hopper 12 and receive therefrom the stream of commingled items 14 of heavy fraction materials. The items 14 are carried by belt 16 to an output roller 20 having coupled to its periphery a plurality of axially extending permanent magnets (not shown) which hold ferromagnetic items **14*a* onto the belt 16 by the forces of magnetic attraction. Thus, the roller 20 comprises a conventional magnetic separator which causes the ferromagnetic items 14*a* to adhere to belt 16 longer than the nonferromagnetic items 14*b* and drop into a suitably disposed container 22 after the belt 16 has carried the items 14*a* out of the magnetic influence exerted by roller 20. The nonferromagnetic items 14*b* leave the roller 20 tangentially and fall into a conventional vibrator chute 24 which guides the items 14*b* into a suitably thin stream feeding onto a nonferromagnetic materials separator 26** of the ramp-type.

This nonferromagnetic materials separator 26 comprises an elongated planar panel 28 which is longitudinally inclined with respect to a substantially horizontal upper surface 32 of a base support member 30 and, in addition, tilted by raising a longitudinal edge vertically relative to the opposite longitudinal edge. Panel 28 has its lower longitudinal edge pivotally secured by suitable means, such as spaced hinges 34, for example, to the upper surface 35 of an inclined platform 37 which is in turn supported at an angle of longitudinal inclination to horizontal base 30 by telescopic posts 38 (only one being shown). Thus, the telescopic posts 38 may be adjusted to dispose the platform 37 longitudinally at a desired angle of longitudinal inclination $\theta$ with respect to surface 32 of base member 30. Additionally, the telescopic posts 36 and 40 may be adjusted to dispose the panel 28 transversely at a desired angle of tilt $\phi$ with respect to surface 35 of inclined platform 37.

The panel 28 is made of rigid nonmagnetic material, such as wood, for example, and has an upper surface disposed between longitudinally extending gutters, 44 and 46, respectively, which have outer edges defined by upwardly extending, side walls, 48 and 50, respectively. Cut into the upper surface of panel 28 is a generally rhomboid-shaped cavity 52 having straight parallel sides adjacent the respective gutters 44, 46 and having parallel sloped ends adjacent the respective upper and lower end portions of panel 28. The sloped ends of cavity 52 extend transversely of the panel 28 at a predetermined angle, such as forty-five degrees, for example, with its longitudinal centerline. Also, in going transversely of panel 28 from the low longitudinal side to the high longitudinal side thereof, the sloped ends of cavity 52 extend downward longitudinally of the panel 28.

Cavity 52 has a bottom surface covered with a sheet 54 of high magnetic permeability material, such as mild steel, for example, which serves as a magnetic flux return path. Disposed transversely in the cavity 52 and substantially parallel with the sloped ends thereof are contiguous rows of permanent bar magnets 56 which have respective upper surfaces substantially flush with the upper surface of panel 28. Thus, the magnets 56 substantially fill the cavity 52 from one sloped end to the other sloped end thereof, and have respective thicknesses which are substantially equal to the depth of cavity 52. Although each of the magnets 56 is shown as a single continuous bar magnet, it is to be understood that each of the magnets 56 may be made up of sequential portions which, in combination, are equivalent to a single bar magnet.

Figure 2:
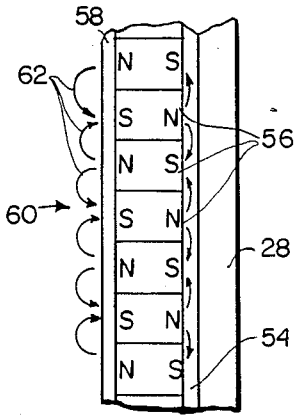
FIG. 2 is a longitudinal sectional view taken along the line 2—2 shown in FIG. 1 and looking in the direction of the arrows.

The magnets 56 are magnetized in the direction of their respective thicknesses and are disposed with respect to one another to provide an alternating series of magnetic north and south pole substantially parallel to one another. The alternating series of magnetic north and south poles extends transversely of the upper surface of panel 28 at the predetermined angle, such as forty-five degrees, for example, with the longitudinal centerline of said surface. Overlying the magnets 56 and the uppr surface of panel 28 is a substantially smooth sheet or layer 58 of non-magnetic material, such as austenitic stainless steel, for example. Consequently, as shown in FIG. 2, there is established above the layer 58 and longitudinally along the panel 28 a spatially alternating array 60 of oppositely directed and substantially parallel magnetic fields 62 which extend transversely at an oblique angle with respect to the longitudinal centerline of panel 28.

Figure 3:
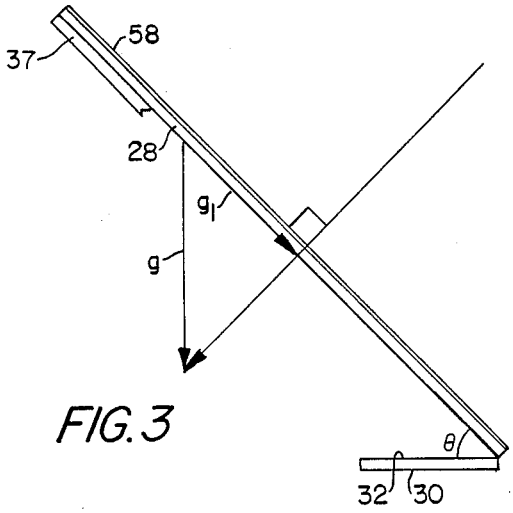
FIG. 3 is a diagrammatic view of gravity vector forces acting longitudinally of the ramp surface shown in FIG. 1.

In operation, the commingled items **14*b* of nonferromagnetic materials falling from the output end of chute 24 are deposited on the smooth surface layer 58 at the upper end portion of panel 28. As shown in FIG. 3, since the panel 28 is inclined longitudinally at an angle 8 with the surface 32 of base member 30, gravity acts on $\theta$ deposited item 14*b* with a force which may be represented by the vector g normal to the base surface 32. The vector g has a component $g_1$ which is directed along the panel 28 and is equal to g sin $\theta$. Consequently, the items 14*b* deposited on surface layer 58 from chute 24 commence to slide longitudinally down the panel 28** under the influence of the gravity component $g_1$.

Figure 4:
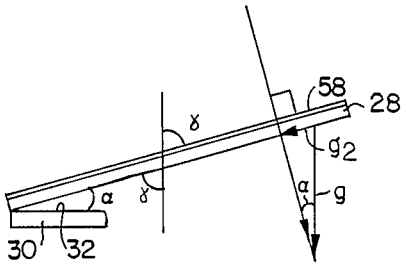
FIG. 4 is a diagrammatic view of gravity vector forces acting transversely of the ramp surface shown in FIG. 1.

As shown in FIG. 4, the panel 28 also is inclined transversely at an angle $\alpha$ with respect to the surface 32 such that the higher and lower longitudinal half portions of panel 28 form respective acute angles $\gamma$ with a plane extending vertically through the longitudinal center1ine of panel 28. As a result, the deposited items **14*b* also are subjected to a component $g_2$ of gravity which is equal to g sin $\alpha$. This $g_2$ component of gravity is directed laterally of the panel 28 from the high toward the lower longitudinal side thereof. Therefore, the items 14*b* deposited on surface layer 58 from chute 24 also commence to slide laterally toward the lower longitudinal side of panel 28 while sliding longitudinally down the panel 28**.

Figure 5:
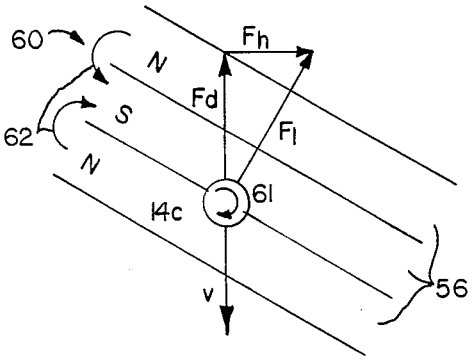
FIG. 5 is a diagrammatic view of electromagnetic vector forces acting on an electrically conductive item.
Figure 6:
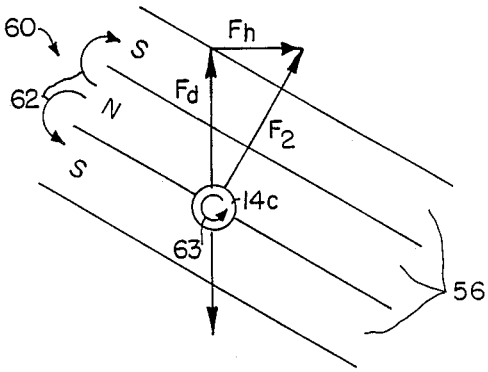
FIG. 6 is another diagrammatic view of electromagnetic vector forces acting on the electrically conductive items shown in FIG. 5.

As shown in FIGS. 5 and 6, the items **14*b* of nonferromagnetic material deposited on panel 28 from chute 24 include electrically conductive items 14*c* which slide down the panel 28 with a velocity having a Iongitudinally directed component v parallel to the surface layer 58. accordingly, the electrically conductive items 14*c* pass sequentially through the spatially alternating fields 62 of the array 60 and cut their lines of magnetic flux. As a result, there is induced in each of the electrically conductive items 14*c* a respective eddy-current which is proportional to the rate of change in the magnetic flux enclosed by the item. Consequently, maximum eddy-currents are induced when the items 14*c* cross the interfacing boundaries between adjacent magnets 56** where the maximum changes in flux occur.

As taught in the aforementioned U.S. Pat. No. 4,003,830 with respect to an item **14*c* comprising a ring or disc of aluminum material, the item 14*c* in passing from a region over a south magnetic pole to a region over a north magnetic pole has induced in it a clockwise eddy-current designated by the curl vector 61. As a result, there is exerted on the item 14*c* a force $F_l$ which is in a plane parallel with the panel 28 and substantially perpendicular to the magnets 56. The force $F_1$ can be resolved into two components, one designated as $F_d$ which is directed longitudinally upward of the sloped surface layer 58** and the other designated as $F_h$ which is directed laterally of the component $F_d$.

Similarly, when the item **14*c* is passing from a region over a north magnetic pole to a region over a south magnetic pole, there is induced in the electrically conductive item 14*c*, a counterclockwise eddy-current designated by curled vector 63 As a result, there is exerted on the item 14*c*, a force designated as $F_2$ which also is in the plane parallel with panel 28 and directed substantially perpendicular to the magnets 56. Consequently, the force $F_2$ may be resolved into two components, one designated as $F_d$ which is directed longitudinally upward of the sloped surface layer 58** and the other designated as $F_h$ which is directed laterally of the component $F_d$.

The respective components $F_d$ of forces $F_1$ and $F_2$ may be referred to as decelerating components since they are directed oppositely to the longitudinal velocity component v. However, these decelerating components $F_d$ of forces $F_1$ and $F_2$ are insignificant in comparison to the longitudinal gravity component $g_1$ acting to slide the items **14*c* longitudinally down the panel 28. On the other hand, the respective components $F_h$ of the forces $F_1$ and $F_2$ are significant in that they act sequentially in a uniform lateral direction to overcome the laterally directed gravity component $g_2$ and deflect the items 14*c* laterally upward of the transversely sloped surface layer 58**.

Figure 7:
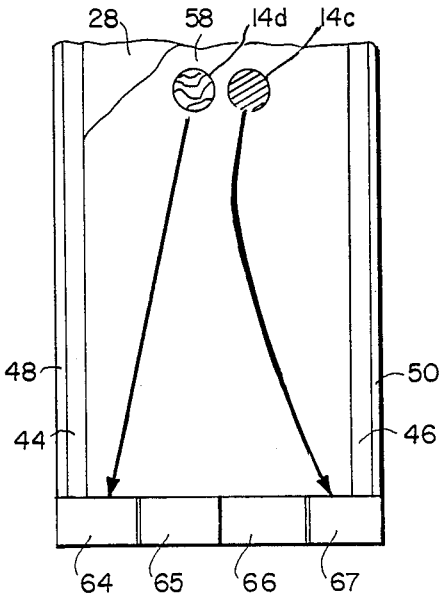
FIG. 7 is a schematic view of a dielectric item and an electrically conductive item on the ramp surface shown in FIG. 1.

Accordingly, as shown in FIG. 7, when a dielectric item **14*d* of nonferromagnetic material is deposited on surface layer 58 at the upper end portion of panel 28 and adjacent the higher longitudinal side thereof, the dielectric item 14*c* slides longitudinally down the panel 28 under the influence of the longitudinal gravity component $g_1$. Simultaneously, the item 14*c* slides transversely toward the lower longitudinal side of panel 28 due to the influence of the laterally directed gravity component $g_2$. As a result, the dielectric items 14*c* may be collected in a container 64 placed at the lower end of panel 28** and adjacent the lower longitudinal side thereof.

On the other hand, when an electrically conductive item **14*c* of nonferromagnetic material is deposited on the surface layer 58, it commences to slide both longitudinally and laterally just as dielectric item 14*d*. However, when the item 14c reaches the oppositely directed magnetic fields 62 of array 60 and cuts the lines of flux thereof, the described laterally directed force components $F_h$ shown in FIGS. 5 and 6 are developed. As a result, the electrically conductive items 14c while sliding longitudinally down the panel 28 are deflected laterally upward toward the higher longitudinal side of the panel 28. Consequently, the electrically conductive items 14c may be collected in a container 67 at the lower end of panel 28** and adjacent the higher longitudinal side thereof.

If desired, containers, such as 65 and 66, for example, may be placed between the respective containers 64 and 67 for collecting electrically conductive items 14c which are not deflected as far laterally as the items 14c collected in container 67. The gutter 44 is provided adjacent the lower longitudinally side of panel 28 for collecting the dielectric items 14d sliding off the adjacent longitudinal edge of surface 58 before reaching the lower end of panel 28. These dielectric items 14d slide longitudinally down the gutter 44 and into container 64. Similarly, the gutter 46 is provided adjacent the higher longitudinal side of panel 28 for collecting the electrically conductive items 14d deflected off the adjacent longitudinal edge of surface 58 before reaching the lower end of panel 28. These electrically conductive items 14c slide longitudinally down the gutter 46 and into container 67.

Figure 8:
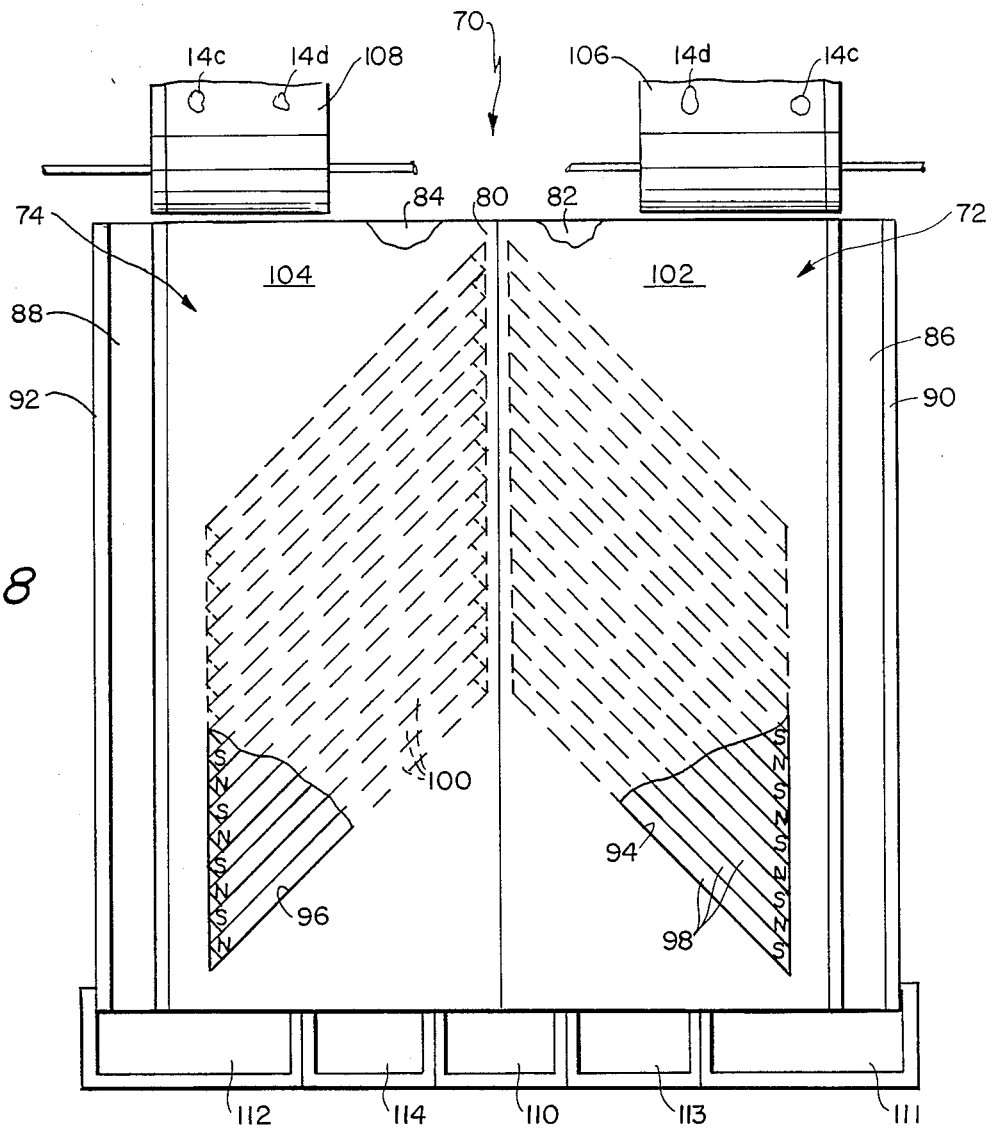
FIG. 8 is a schematic plan view of an alternative embodiment of the invention.
Figure 9:
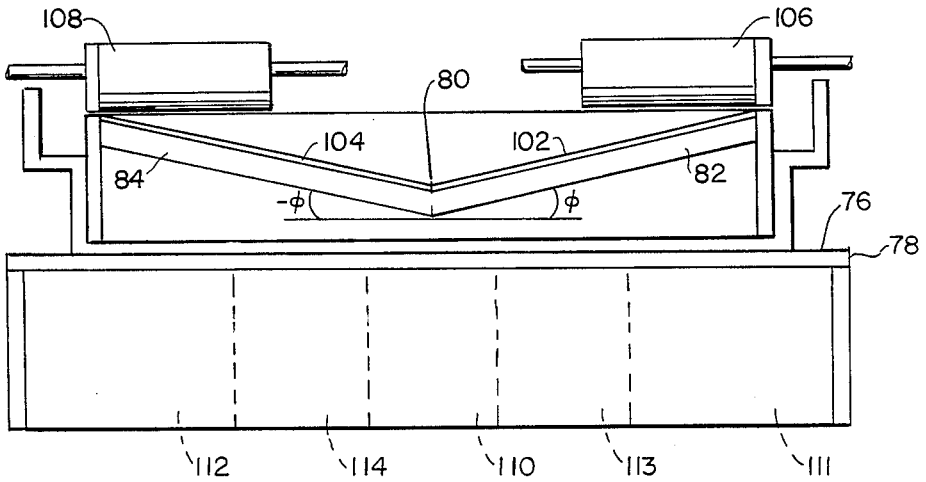
FIG. 9 is a schematic end view of the alternative embodiment shown in FIG. 8.

In FIGS. 8 and 9, there is shown an alternative embodiment comprising a materials separator apparatus 70 of the dual ramp type having a right longitudinal half which is similar to the apparatus 10 shown in FIG. 1 and a left longitudinal half which is a mirror image of the right longitudinal half. The right and left longitudinal halves of apparatus 70 include respective right and left ramps 72 and 74 which are longitudinally inclined at a uniform angle $\theta$ (not shown) with respect to a substantially horizontal upper surface 76 of a base supporting member 78. The right and left ramps 72 and 74 also are inclined transversely from the longitudinal centerline of apparatus 70 and form respective positive and negative angles of transverse tilt $\phi$. Thus, the right and left ramps 72 and 74 have abutting longitudinal sides and extend transversely therefrom in reverse angulated relationship with respect to one another to form a central trough 80 along the longitudinal centerline of apparatus 70.

The right and left ramps 72 and 74 comprise respective panels 82 and 84 which have juxtaposed longitudinal side portions forming the trough 80 and are made of rigid nonmagnetic material, such as wood, for example. The opposing longitudinal side portions of panels 82 and 84 extend along respective right and left gutters 86 and 88 which have outer longitudinal edges defined by respective longitudinal side walls 90 and 92 which extend upwardly of the upper surface of panels 82 and 84, respectively. Cut into the upper surfaces of panels 82 and 84 are respective rhomboid-shaped cavities 94 and 96 which have straight longitudinal sides adjacent the respective gutters 86, 88 and have opposing longitudinal sides adjacent the longitudinal centerline of apparatus 70. The cavities 94 and 96 have respective opposing sloped ends disposed adjacent the upper and lower end portions of the panels 82 and 84, respectively. However, the opposing sloped ends of the cavities 94 and 96 extend transversely of the respective panels 82 and 84 in reverse angulated relationship relative to the longitudinal centerline of apparatus 70. Consequently, the sloped ends of cavity 94 extend downwardly of the panel 82 in going toward the gutter 86; and the sloped ends of cavity 96 extend downwardly of the panel 84 in going transversely toward the opposing gutter 88.

Each of the cavities 94 and 96 is substantially filled with a series of permanent bar magnets 98 and 100, respectively, which are disposed substantially parallel with the sloped ends of the respective cavities 94 and 96. As a result, the respective magnets 98 and 100 form a chevron pattern having sloped side portions which extend transversely of the panels 82 and 84, respectively, at an oblique angle relative to the longitudinal centerlines thereof. The magnets 98 and 100 have respective thicknesses substantially equal to the depths of cavities 94 and 96, respectively. Magnets 98 and 100 are magnetized in the direction of their thicknesses to provide adjacent the upper surfaces of panels 82 and 84 respective alternating series of north and south magnetic poles. Each of the panels 82 and 84 together with the associated magnets, 98 and 100, respectively, is covered with a smooth surface layer, 102 and 104, of nonmagnetic material, such as austenitic stainless steel, for example.

Accordingly, there is established above the layers 102 and 104 and along the ramps 72 and 74 respective spatially alternating arrays of oppositely directed magnetic fields which are extended in substantially parallel relationship. The arrays of magnetic fields extend transversely at an oblique angle relative to the longitudinal centerlines of the respective ramps 72 and 74 such that the magnetic fields form a herringbone pattern with the central trough extended along the longitudinal centerline of apparatus. Consequently, dielectric items 14d of nonferromagnetic material deposited on the upper end portions of the respective ramps 72 and 74 from overlying conveyor belts, 106 and 108, positioned adjacent the high longitudinal sides thereof will slide both longitudinally and transversely down the respective surface layers 102 and 104. As a result, the dielectric items 14d will enter the trough 80 and be directed into an aligned container 110 at the bottom of the trough 80. On the other hand, electrically conductive items 14c deposited on the ramps 72 and 74 from the respective belts 106 and 108 will begin to slide longitudinally and transversely until they reach the respective spatially alternating arrays of oppositely directed magnetic fields established above the surface layers 102 and 104, respectively. In passing through these fields the electrically conductive items 14c will have induced therein respective eddy-currents which coact with the magnetic fields to produce a resultant force having a laterally directed component for deflecting the items 14c laterally. As a result, the items 14c will enter the gutters 86 and 88, respectively, to be directed to aligned containers, 111 and 112, respectively, at the lower ends of ramps 72 and 74, respectively. If desired, there may be disposed at the lower ends of ramps 72 and 74 respective containers 113 and 114 for collecting the "middlings".

Figure 10:
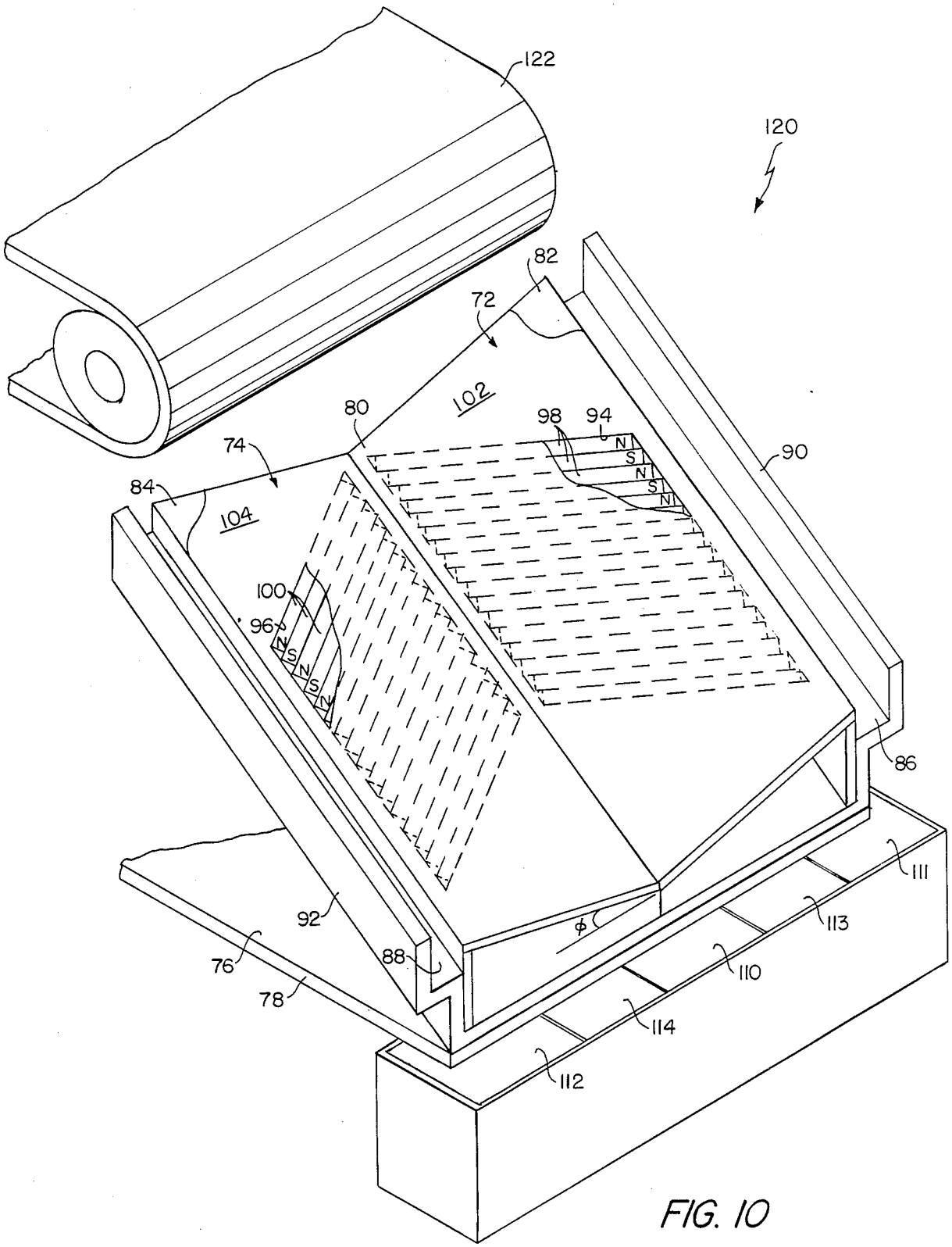
FIG. 10 is a schematic isometric view of another alternative embodiment of the invention.

In FIG. 10, there is shown another alternative embodiment including materials separator apparatus 120 which is similar to the apparatus 70 shown in FIGS. 8 and 9 except the input feed means comprises a materials conveyor 122 which extends transversely over the entire upper end portions of ramp 72 and 74, respectively. Thus, commingled items 14c and 14d of nonferromagnetic material may be deposited from the conveyor 122 across the combined widths of the respective ramps 72 and 74 rather than only on their upper end portions adjacent the respective high longitudinal sides thereof as shown in FIGS. 8 and 9. Consequently, the apparatus 120 is enabled to handle a greatly increased load capacity, as compared to apparatus 70, since more input material can be treated, for a given burden depth and flow velocity, as the input stream of commingled items 14c and 14d is widened.

Figure 11:
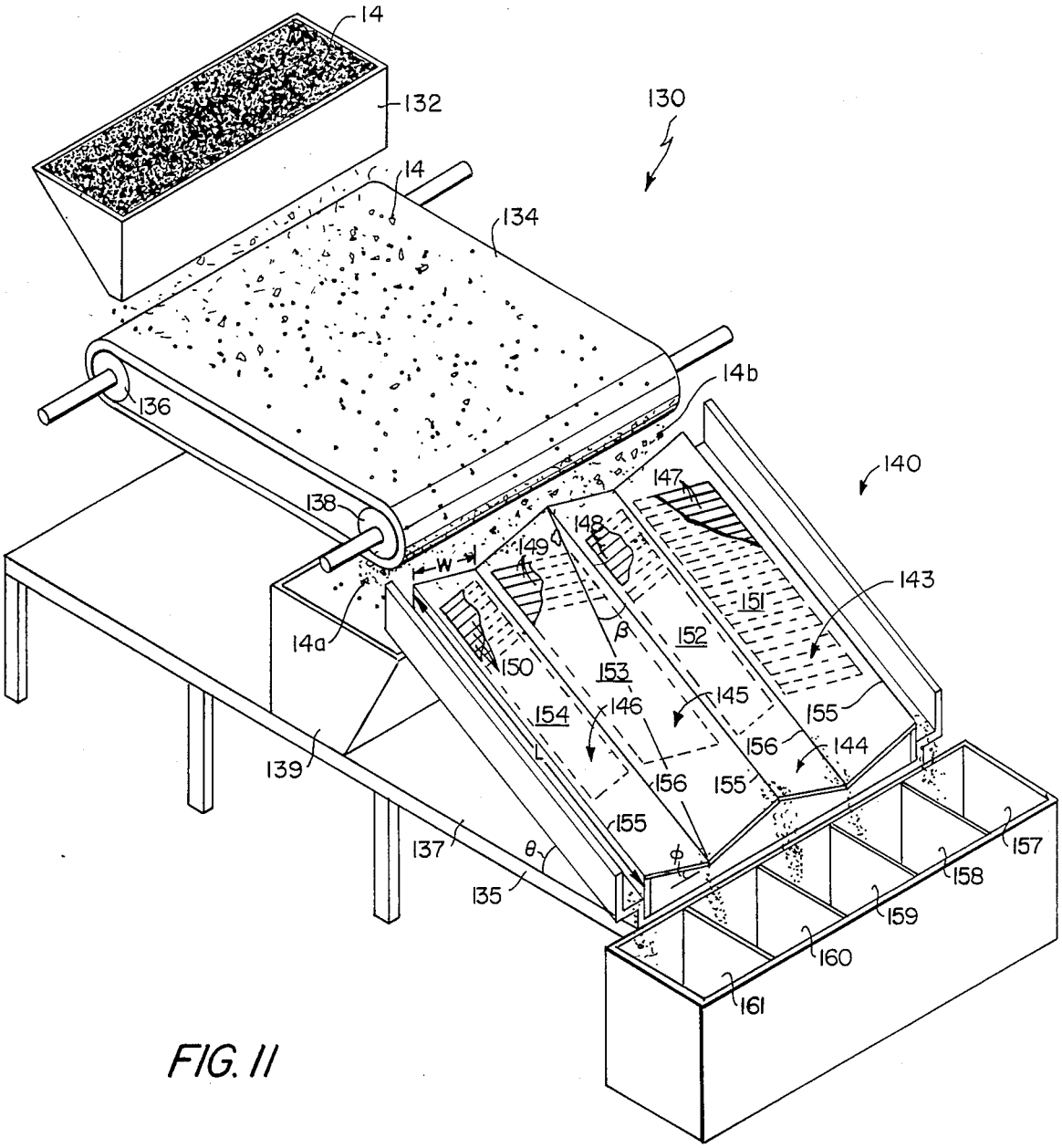
FIG. 11 is a schematic isometric view of still another alternative embodiment of the invention.

In FIG. 11 there is shown another alternative embodiment including materials separator apparatus 130 having an input feed hopper 132 with a relatively wide output end portion disposed over a relatively wide conveyor belt 134. The belt 134 passes around a drive roller 136 and under the output end portion of hopper 132 to receive therefrom commingled items 14 of heavy fraction material. Belt 134 conducts the commingled items 14 to an output roller 138 which is of the magnetic separator type having a plurality of axially extending magnets (not shown) in its periphery. Consequently, ferromagnetic items 14c cling to the belt 134 longer than the nonferromagnetic items 14b, and are deposited in a suitably disposed container 139. The nonferromagnetic items 14b leave the belt 134 tangentially of the roller 138 and are deposited all along the upper end portion of a corrugated type ramp separator 140.

Separator 140 comprises a longitudinally juxtaposed array of elongated planar ramps 143, 144, 145 and 146 which are inclined longitudinally at a uniform angle $\theta$ with respect to a substantially horizontal upper surface 137 of a base support member 135 and inclined transversely at a uniform tilt angle $\phi$. Adjacent ramps of the array have abutting longitudinal edge portions from which they slope transversely in reverse angulated relationship to form alternate crests 155 and troughs 156 which extend longitudinally the entire length of the array. Thus, it may be seen that pairs of adjacent ramps, such as 143, 144 and 145, 146, for examples form respective dual ramp separators similar to the trough formed between reverse angulated ramps.

Each of the ramps 143–146 comprises a planar panel having adjacent its upper an alternating series of north and south magnetic poles 147–150, respectively, which are disposed substantially parallel and extend transversely at an oblique angle with the longitudinal centerline of the respective ramp. Also, each of the ramps 143–146 has a smooth surface layer 151–154 overlying its respective panel and its respective magnetic poles 147–150. Consequently, each of the ramps 143–146 has established above its respective surface layer 151–154 a spatially alternating array of oppositely directed and substantially parallel magnetic fields which extend transversely at an oblique angle with the longitudinal centerline of the ramp. Disposed at the lower end portion of separator 140 is a plurality of containers 157–161, the containers 157, 159 and 161 being aligned with respective crests 155 and the containers 158 and 160 being aligned with respective troughs 156.

From geometric relationships indicated in FIG. 11, it can be shown that $$(1)\ \tan\beta = \sin\phi/\tan\theta$$

where $\beta$ is the angle formed between the fall path of a dielectric item 14d and the longitudinal side of a ramp, such as 146, for example. In order to obtain good segregation of the electrically conductive items 14c and the dielectric items 14b, it is important that the ramp 146 be disposed at a transverse inclination angle sufficiently large to assure that dielectric items 14b will reach the bottom of a trough 156 independently of where the item 14d is deposited on the upper end portion of ramp 146. On the other hand, the ramp 146 should not be disposed at such a large transverse inclination angle $\phi$ such as greater than ten degrees, for example, that a substantial quantity of electrically conductive items 14c are prevented from reaching the crest 155. A reasonable compromise between these conflicting requirements is to select a transverse inclination angle $\phi$ such that a dielectric item 14d starting at the upper end portion of ramp 146 and near the crest 155 will be directed into trough 156 near the lower end of ramp 146. Accordingly, since ramp 146 has a length L and a width W, the desired transverse inclination angle $\phi$ can be expressed as:

$$(2)\ \sin\phi = (W/L)\tan\theta.$$

Thus, for example, if the ramp 146 is disposed at a longitudinal inclination angle $\theta$ of approximately forty-five degrees, has a width of five and three-quarter inches and a length of ten feet, the optimal transverse inclination tilt angle $\phi$ is two and three quarter degrees. It has been shown previously that the lateral deflection of an electrically conductive item, such as 14c, for example, in a relatively moving magnetic field is dependent on the size and shape of the item as well as on the ratio of its electrical conductivity to its mass density. In addition, as shown by operation of the transversely tilted ramp-type separator of this invention, the lateral deflection of electrically conductive item 14c also is dependent on the angle between the fall line of item 14c and the obliquely disposed magnets 150. Accordingly, for optimal operation of the transversely tilted ramp-type separator, the magnets 150 may be preferably disposed transversely of the ramp 146 at an oblique angle with longitudinal centerline thereof which compensates for the resulting fall line of electrically conductive items, such as 14c, for example.

Figure 12:
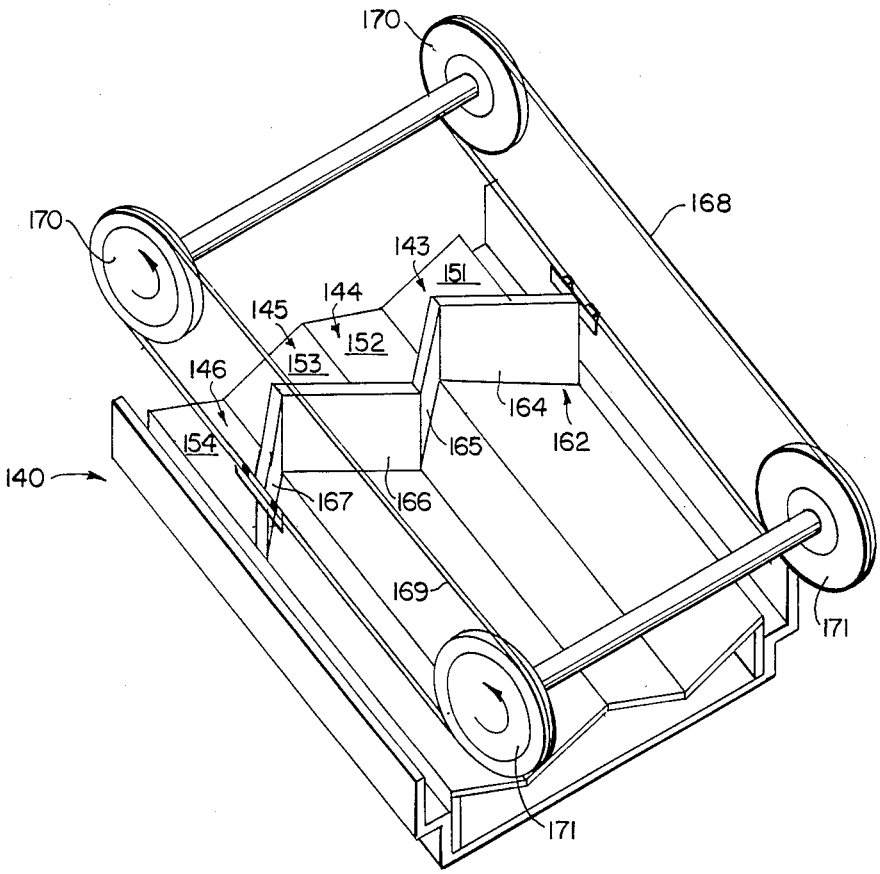
FIG. 12 is a schematic isometric view of the embodiment shown in FIG. 11 provided with an auxiallary cleaning device.

As shown in FIG. 12, the corrugated ramp-type separator 140 shown in FIG. 11 may be provided with a means for periodically removing magnetic particles, such as 14a, for example, which pass by the magnetic separator roller 138 and adhere to the surface layers 151–154, respectively. The magnetic particle removing means comprises a zig-zag sweeper device 162 carried by respective endless cables 168 and 169 which pass around respective pairs of spaced sprockets 170 and 171. The cables 168 and 169 carry the device 162 into contacting relationship along the respective surface layers 151–154 of the ramps 143–146. Device 162 comprises a plurality of reverse angulated blade portions 164–167 provided with respective felt or rubber edges which sweep longitudinally down the surface layers 151–154 once each revolution of the cables 168 and 169, respectively, and preferably at the rate which commingled items 14c and 14d travel down the respective surface layers 151–154. Since magnetic particles swept from the surface layers 151–154 tend to follow along the underlying magnets 147–150, it is preferred that the blade portions 164–167 of sweeper device 162 be disposed at sharper angles with the longitudinal centerlines of the respective ramps 143–146 then the magnets 147–150 (FIG. 11), respectively. As a result, the magnetic particles swept by the felt or rubber edges of the blade portions 164–167 from the surface layers 151–154, respectively, travel toward the lower longitudinal sides of the respective ramps 143–146 and are mixed with the "tailings" in containers 158 and 160, respectively. Thus, the swept magnetic particles do not pose a problem when the "concentrates" in containers 157, 159 and 161, respectively, are re-cycled through the separator of the ramp-type for further refinement.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. Materials separator apparatus comprising:

material guide means including a base and a plurality of elongated receiving surfaces having respective longitudinal centerlines, said surfaces being disposed in juxtaposed relationship transversely to said longitudinal centerlines, said surfaces being sloped at a preferred angle of longitudinal inclination with respect to the base, adjacent surfaces having contiguous first longitudinal edges and being sloped transversely upward therefrom relative to the base at respective reverse angles of transverse inclination greater than zero degrees and no greater than ten degrees in magnitude, said adjacent surfaces defining an interposed trough for receiving commingled dielectric items and electrically conductive items and directing said items along paths extended longitudinally and transversely downward of said surfaces in directions related to said respective reverse angles of transverse inclination, said items being directed transversely downward of said surfaces under the influence of transversely directed components of gravity having respective magnitudes limited by said angles of transverse inclination;

steady-state magnetic means magnetically coupled to each of said surfaces for forming along each of said surfaces a respective spatially alternating array of oppositely directed static magnetic fields extending transversely at an oblique angle relative to said respective longitudinal centerlines and subjecting said electrically conductive items to electromagnetic forces having lateral components directed transversely upward of said surfaces in opposition to said transversely directed components of gravity having respective magnitudes limited by said angles of transverse inclination, said oblique angle being predetermined with respect to said longitudinal centerlines for providing said lateral components with respective magnitudes greater than said respective magnitudes of said transversely directed components of gravity and producing lateral deflection of said electrically conductive items transversely upward of said surfaces, said oblique angle also being predetermined for disposing said magnetic fields at a preferred angle to said paths and increasing said lateral deflection of said electrically conductive items transversely upward of said surfaces; and said plurality of receiving surfaces being disposed in corrugated array and each adjacent surface extending transversely upward from respective first longitudinal edges to respective second longitudinal edges disposed in contiguous relationship with respective second longitudinal edges of adjacent surfaces and forming therewith respective crests in said corrugated array.

2. Materials separator apparatus as set forth in claim 1 further comprising input material feed means for depositing said commingled items transversely across said corrugated array of said receiving surfaces, said crests in the corrugated array comprising splitter means for directing said commingled items into said troughs in the corrugated array.

3. Materials separator apparatus as set forth in claim 1 wherein said commingled items are directed along said paths at an angle $\beta$ with said first logitudinal edges in accordance with the relationship:

$$\tan \beta = \sin \phi / \tan \theta$$

where $\theta$ is said angle of longitudinal inclination and $\phi$ is said angle of transverse inclination.

4. Material separator apparatus as set forth in claim 3 wherein said angle of transverse inclination is determined by the relationship:

$$\sin \phi = (W/L) \tan \theta$$

where L is the length of any one of said surfaces and W is the width of the surface.

5. Materials separator apparatus comprising:

material guide means including a base and a plurality of elongated receiving surfaces having respective longitudinal centerlines, said surfaces being disposed in juxtaposed relationship transversely to said longitudinal centerlines, said surfaces being sloped at a preferred angle of longitudinal inclination with respect to the base, adjacent surfaces having contiguous first longitudinal edges and being sloped transversely upward therefrom relative to the base at respective reverse angles of transverse inclination greater than zero degrees and no greater than ten degrees in magnitude, said adjacent surfaces defining an interposed trough for receiving commingled dielectric items and electrically conductive items and directing said items along paths extended longitudinally and transversely downward of said surfaces in directions related to said respective reverse angles of transverse inclination, said items being directed transversely downward of said surfaces under the influence of transversely directed components of gravity having respective magnitudes limited by said angles of transverse inclination;

steady-state magnetic means magnetically coupled to each of said surfaces for forming along each of said surfaces a respective spatially alternating array of oppositely directed static magnetic fields extending transversely at an oblique angle relative to said respective longitudinal centerlines and subjecting said electrically conductive items to electromagnetic forces having lateral components directed transversely upward of said surfaces in opposition to said transversely directed components of gravity having respective magnitudes limited by said angles of transverse inclination, said oblique angle being predetermined with respect to said longitudinal centerlines for providing said lateral components with respective magnitudes greater than said respective magnitudes of said transversely directed components of gravity and producing lateral deflection of said electrically conductive items transversely upward of said surfaces, said oblique angle also being predetermined for disposing said magnetic fields at a preferred angle to said paths and increasing said lateral deflection of said electrically conductive items transversely upward of said surfaces; and said material guide means including magnetic sweeper means comprising a zig-zag sweeper device having respective blades movable along respective receiving surfaces of said plurality.

6. Materials separator apparatus as set forth in claim 5 wherein each of said blades has a yieldable portion movable in contacting relationship with said respective receiving surfaces.

7. Materials separator apparatus as set forth in claim 6 wherein said blades are movable along said respective receiving surfaces at a more acute angle with respect to said first longitudinal edges thereof than the angle of the magnetic fields relative to said first longitudinal edges.

* * * * *